US008733473B2

(12) United States Patent
Nadeau et al.

(10) Patent No.: US 8,733,473 B2
(45) Date of Patent: May 27, 2014

(54) SEQUENCING ALGORITHM FOR PLANNED DRILL HOLES

(75) Inventors: Frederic Nadeau, Laval (CA); Daniel Francis Stanek, Chillicothe, IL (US)

(73) Assignee: Caterpillar Inc., Peoria, IL (US)

( * ) Notice: Subject to any disclaimer, the term of this patent is extended or adjusted under 35 U.S.C. 154(b) by 622 days.

(21) Appl. No.: 12/938,095

(22) Filed: Nov. 2, 2010

(65) Prior Publication Data

US 2012/0103598 A1 May 3, 2012

(51) Int. Cl.
*E21B 44/00* (2006.01)

(52) U.S. Cl.
USPC ..... 175/24; 173/2; 700/173

(58) Field of Classification Search
CPC ..... E21B 7/022; E21B 44/00; B23K 26/0853; G06Q 10/047; G05B 19/182; G05B 2219/49363; G05B 2219/49372; G05B 2219/49378
USPC ..... 219/121.78, 121.82, 121.8; 175/24, 27; 700/173; 173/2
See application file for complete search history.

(56) References Cited

U.S. PATENT DOCUMENTS

| | | | | |
|---|---|---|---|---|
| 4,639,868 | A | 1/1987 | Tanaka et al. | |
| 5,200,677 | A | 4/1993 | Dueck et al. | |
| 5,533,841 | A | 7/1996 | Iwano et al. | |
| 5,699,261 | A | 12/1997 | Muona | |
| 5,913,199 | A * | 6/1999 | Dueck et al. | 705/7.26 |
| 6,128,546 | A * | 10/2000 | Basista et al. | 700/166 |
| 6,239,406 | B1 * | 5/2001 | Onoma et al. | 219/121.82 |
| 6,495,791 | B2 * | 12/2002 | Hunter et al. | 219/121.6 |
| 6,618,658 | B1 | 9/2003 | Kagoshima et al. | |
| 6,957,707 | B2 | 10/2005 | Koivunen et al. | |
| 7,504,627 | B2 | 3/2009 | Takahashi et al. | |
| 7,681,660 | B2 | 3/2010 | Muona | |
| 8,392,014 | B2 * | 3/2013 | Saleniemi et al. | 700/182 |
| 2003/0018401 | A1 | 1/2003 | Sorkin | |
| 2009/0196699 | A1 | 8/2009 | Elfizy | |
| 2011/0224859 | A1 * | 9/2011 | Pipponen et al. | 701/22 |
| 2012/0024605 | A1 * | 2/2012 | Elinas et al. | 175/57 |

* cited by examiner

*Primary Examiner* — Shane Bomar
*Assistant Examiner* — Kipp Wallace
(74) *Attorney, Agent, or Firm* — Finnegan, Henderson, Farabow, Garrett & Dunner LLP

(57) ABSTRACT

A method for sequencing drill holes for a mobile drill rig is disclosed. The method may include receiving a hole pattern having a plurality of planned holes and generating at least a first group of parallel pathways and a second group of parallel pathways between the plurality of holes of the hole pattern. The first group of pathways may be angled relative to the second group of pathways. The method may also include selecting between the first group of pathways and the second group of pathways based on which group of pathways includes fewer total pathways. The method may further include generating a combined pathway by linking at least one pathway from the selected group of pathways to at least a second pathway from the selected group of pathways and transmitting the combined pathway to a module configured to control movement of the mobile drill rig

20 Claims, 5 Drawing Sheets

SEQUENCING ALGORITHM FOR PLANNED DRILL HOLES

TECHNICAL FIELD

The present disclosure relates generally to a sequencing algorithm, and, more particularly, to a sequencing algorithm for planned drill holes for a mobile drill rig.

BACKGROUND

Modern blast hole drilling operations often use maps of the worksite. The maps may include a representation of the geography of the worksite, as well as a planned pattern of holes to be drilled by a drill rig. An operator of the drill rig typically positions the rig at a planned hole location and drills the hole. This process is repeated until all of the planned holes have been drilled. The operator of the drill rig often makes an ad hoc determination of the order in which all of the holes from the drill hole pattern are drilled.

Although allowing the operator to select the order in which the holes are drilled may ultimately complete the task, it may be inefficient. Accordingly, a method for determining and/or optimizing the order in which holes are to be drilled is needed.

One method for improving drilling performance is disclosed in U.S. Pat. No. 6,957,707 to Koivunan et al. ("the '707 patent"). The '707 patent discloses an arrangement for positioning a drilling unit. Specifically, the '707 patent discloses a method and a computer program for controlling a drilling cycle in a rock drilling apparatus. Each drilling unit in the rock drilling apparatus of the '707 device is monitored during a drilling period, and a drilling sequence of a control unit in the rock drilling apparatus is updated at predetermined intervals during the drilling period. The drilling sequence is changed during updating, if changes occur in the drilling conditions during the drilling period.

Although the method of the '707 patent may update a drill hole sequence based on changed conditions, it may still be inefficient. Specifically, the device of the '707 patent may not fully account for efficiency loss due to differences in travel time between holes resulting from different movements of the drill (i.e., movement in some directions may incur a greater time penalty than movement in other directions). Modifying the sequence based on measured conditions may improve efficiency over time, but time may still be wasted as the system seeks for more efficient parameters, thus increasing overall drilling time. This disclosure is directed at overcoming one or more of the problems described above.

SUMMARY

In one aspect, the present disclosure is directed to a method for sequencing drill holes for a mobile drill rig. The method may include receiving a hole pattern having a plurality of planned holes and generating at least a first group of parallel pathways and a second group of parallel pathways between the plurality of holes of the hole pattern. The first group of pathways may be angled relative to the second group of pathways. The method may also include selecting between the first group of pathways and the second group of pathways based on which group of pathways includes fewer total pathways. The method may further include generating a combined pathway by linking at least one pathway from the selected group of pathways to at least a second pathway from the selected group of pathways and transmitting the combined pathway to a module configured to control movement of the mobile drill rig.

In another aspect, the present disclosure is directed to a control system for a mobile drill rig. The control system may include a positioning system configured to determine a position of the drill rig and a controller in communication with the positioning system. The controller may be configured to control movement of the drill rig and receive a hole pattern having a plurality of planned holes spaced apart in at least two directions. The controller may also be configured to generate at least a first group of parallel pathways and a second group of parallel pathways through the plurality of holes of the hole pattern, the first group of pathways being angled relative to the second group of pathways. The controller may further be configured to select between the first group of pathways and the second group of pathways based on which group of pathways includes fewer total pathways and generate a combined pathway by linking at least one pathway from the selected group of pathways to at least a second pathway from the selected group of pathways. The controller may be configured to control movement of the mobile drill based on the combined pathway and the position of the drill rig.

DETAILED DESCRIPTION

Figure 1:
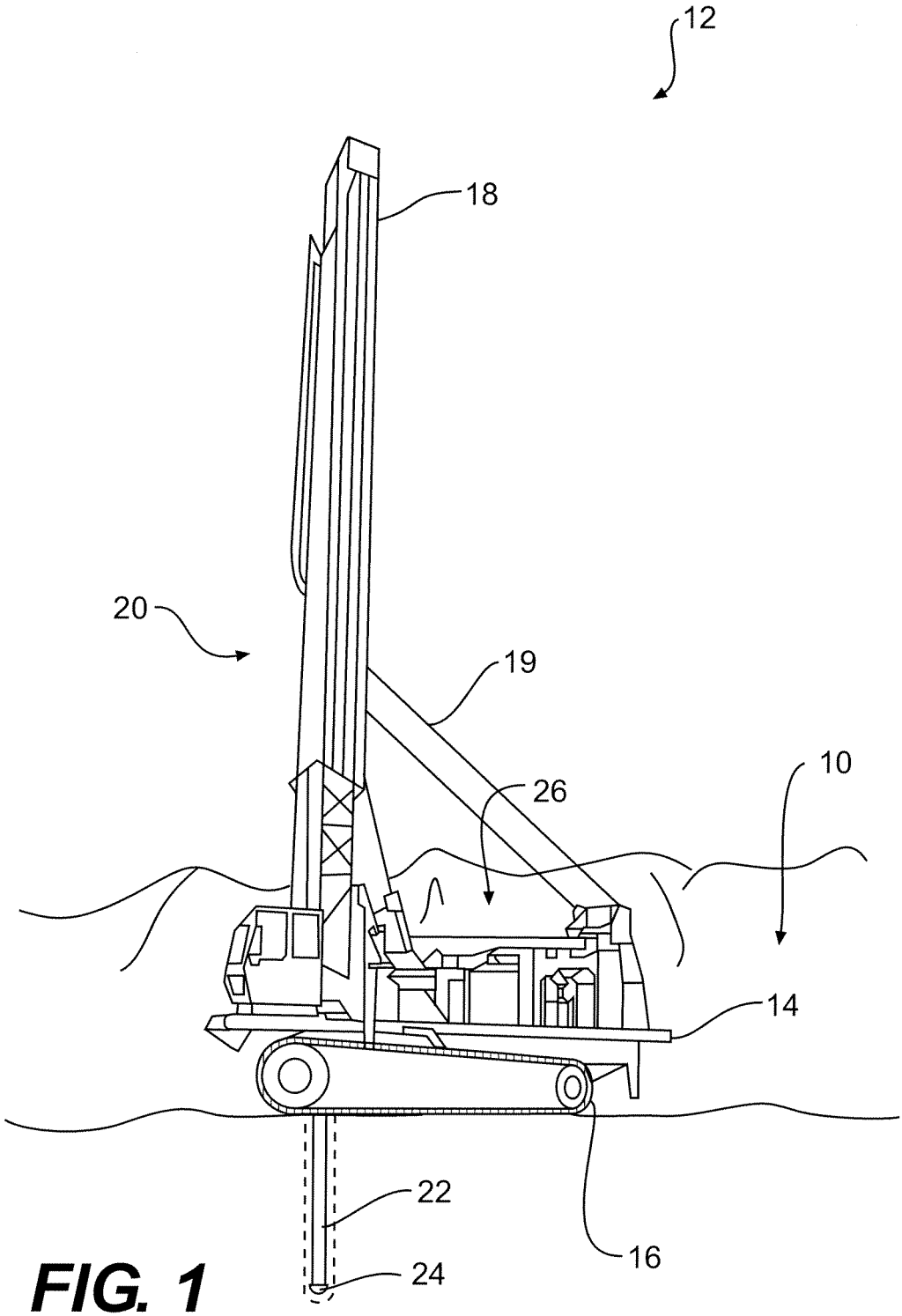
FIG. 1 is a diagrammatic illustration of an exemplary disclosed drill rig.

FIG. 1 illustrates an exemplary worksite 10. Worksite 10 may support a number of operations, including, for example, a mining operation. The mining operation may include sub-operations for removing and processing material, such as drilling, blasting, and hauling. The drilling sub-operation is performed by a machine 12, and may be directed to drilling holes in a surface of worksite 10. Explosives may subsequently be placed in the drilled holes for blasting. After detonating the explosives, loose material remaining in the location of the blasting may be hauled away for removal purposes and/or processing.

Machine 12 is a mobile machine configured to drill holes (e.g., a drill rig). Machine 12 includes a mobile platform 14 configured to move machine 12 about worksite 10. Mobile platform 14 may be coupled to a power source (not shown), such as a diesel or gas powered engine. It is also contemplated that the power source may be located remotely from machine 12. Specifically, the power source may embody a generator which is coupled to machine 12 by a length of power cable.

Machine 12 may also include a plurality of ground engaging devices 16. Ground engaging devices 16 are configured to engage the worksite surface and propel mobile platform 14. Ground engaging devices 16 may include tracks, wheels, or any other ground engaging device known in the art. In the embodiment of FIG. 1, machine 12 includes two ground engaging devices 16, one located on either side of machine 12. It is contemplated, however, that machine 12 may have any appropriate number of ground engaging devices 16.

Machine 12 also includes a mast 18 coupled to mobile platform 14. Mast 18 is a frame configured to hold a drill 20 and allow drill 20 to penetrate into the worksite surface. Mast 18 may be constructed of steel or any other appropriate material. Mast 18 may be directly pivotably connected to mobile platform 14 and may pivot by way of one or more hydraulic actuators 19. Alternatively, mast 18 may be pivotably connected to mobile platform 14 by way of a boom (not shown). It is contemplated that hydraulic actuators 19 may position mast 18 perpendicular to mobile platform 14 in an extended configuration and parallel to mobile platform 14 in a retracted configuration.

Drill 20 includes drill pipe 22, a drill bit 24, and a motor 26 configured to rotate or otherwise advance drill bit 24. It is contemplated that motor 26 may be, for example, a hydraulic or electric motor powered by the power source. It is further contemplated that motor 26 may be omitted, and drill 20 may be driven by the power source via one or more belts and/or gear trains.

Figure 2:
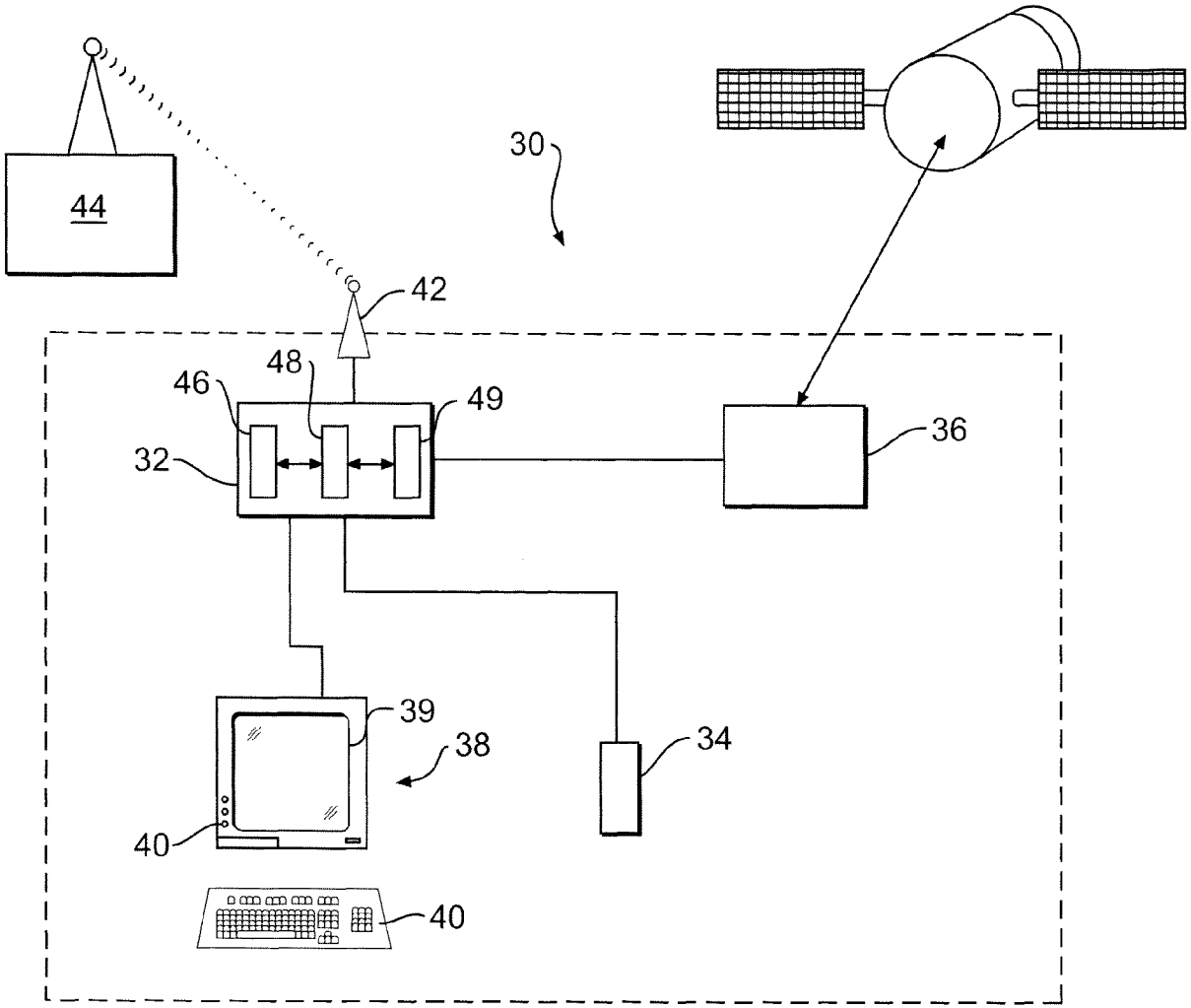
FIG. 2 is a diagrammatic illustration of an exemplary control system for use with the drill rig of FIG. 1.

FIG. 2 illustrates a control system 30 that may be integrated with machine 12 and configured to control one or more operations of machine 12. Control system 30 may be configured to control, for example, drilling into the surface of worksite 10 using drill 20. Control system 30 may also be configured to control movement of machine 12 about worksite 10 (either automatically or with operator assistance). Control system 30 may include a controller 32, one or more sensors 34, a positioning system 36, an operator display 38, operator input devices 40, and a communication device 42.

Controller 32 embodies a computer having a single microprocessor or multiple microprocessors. Numerous commercially available microprocessors may be configured to perform the functions of controller 32. Controller 32 may readily embody a general machine microprocessor capable of controlling numerous machine functions. Various circuits may be associated with controller 32, such as power supply circuitry, signal conditioning circuitry, data acquisition circuitry, signal output circuitry, signal amplification circuitry, and other types of circuitry known in the art.

Controller 32 includes one or more modules configured to control different aspects of machine 12. Controller 32 may include, for example, a sequencing module 46, a positioning module 48, and a drilling module 49. Modules 46, 48, and 49 may be implemented solely by way of software, or may be implemented by way of hardware and software. In an alternative embodiment, each of modules 46, 48, and 49 may be located in a separate controller.

Controller 32 may communicate with positioning system 36, operator display 38, operator input devices 40, and communication device 42. In some embodiments, controller 32 may be configured to communicate with other controllers associated with machine 12. Controller 32 may be connected with sensors 34 to receive feedback for control of machine 12.

Sensors 34 may embody position sensors, velocity sensors, temperature sensors, pressure sensors, force sensors, inclinometers, imaging devices, or any other type of sensor known in the art. For example, feedback from sensors 34 may be used to automatically control movement of machine 12 about worksite 10. Sensors 34 for control of machine movement may include, for example, one or more velocity sensors associated with each of ground engaging devices 16; obstacle detection sensors; and engine speed sensors. Sensors 34 for control of drilling using drill 20 may include one or more rotational speed sensors to determine a speed of drill 20; force sensors configured to sense a torque experienced by drill 20; and sensors configured to track a depth of a drill hole by tracking a position of drill bit 24 or a length (e.g., number of sections) of drill pipe 22 inserted into the drill hole.

Positioning system 36 is configured to determine a position of machine 12. Specifically, positioning system 36 may determine the position of machine 12 within worksite 10. Positioning system 36 may communicate position information to controller 32 or may display the information to the operator. Positioning system 36 may embody, for example, a satellite based device (e.g., GPS, LEO, etc.), a radar based device, a radio frequency based device, or any other appropriate positioning device known in the art. In embodiments where positioning system 36 includes a satellite-based device, it is further contemplated that positioning system 36 may use dead reckoning, when, for example, a satellite signal is lost.

Operator display 38 may be configured to display information to the operator. Operator display 38 may embody an LCD, CRT, LED, or other type of display device. Operator display 38 may be associated with a user interface 39. User interface 39 may be a graphical user interface configured to create, view, store, and/or retrieve information related to one or more machine operations (e.g., drilling, traversing, etc.). User interface 39 may also display information about the worksite, such as topography, relief, contours, obstacles, worksite equipment, and other machines.

User interface 39 may receive input from operator input devices 40. Operator display 38 may be touch sensitive, and user interface 39 may receive input via operator interaction with operator display 38. User interface 39 may include menus, buttons, toolbars, and other means to facilitate the interaction between the operator and machine 12.

Operator input devices 40 may include knobs, buttons, and switches or other types of interfaces known in the art. In some embodiments, operator input devices 40 may include at least one of a keyboard, a mouse, or a trackpad.

Communication device 42 may be satellite-based, RF-based (e.g., cellular, radio, etc.), or other any other type of communication device known in the art. Controller 32 may use communication device 42 to communicate with other machines and/or an operation station 44. Operation station 44 may be, for example, a centralized planning location for the mining operation.

Figure 3:
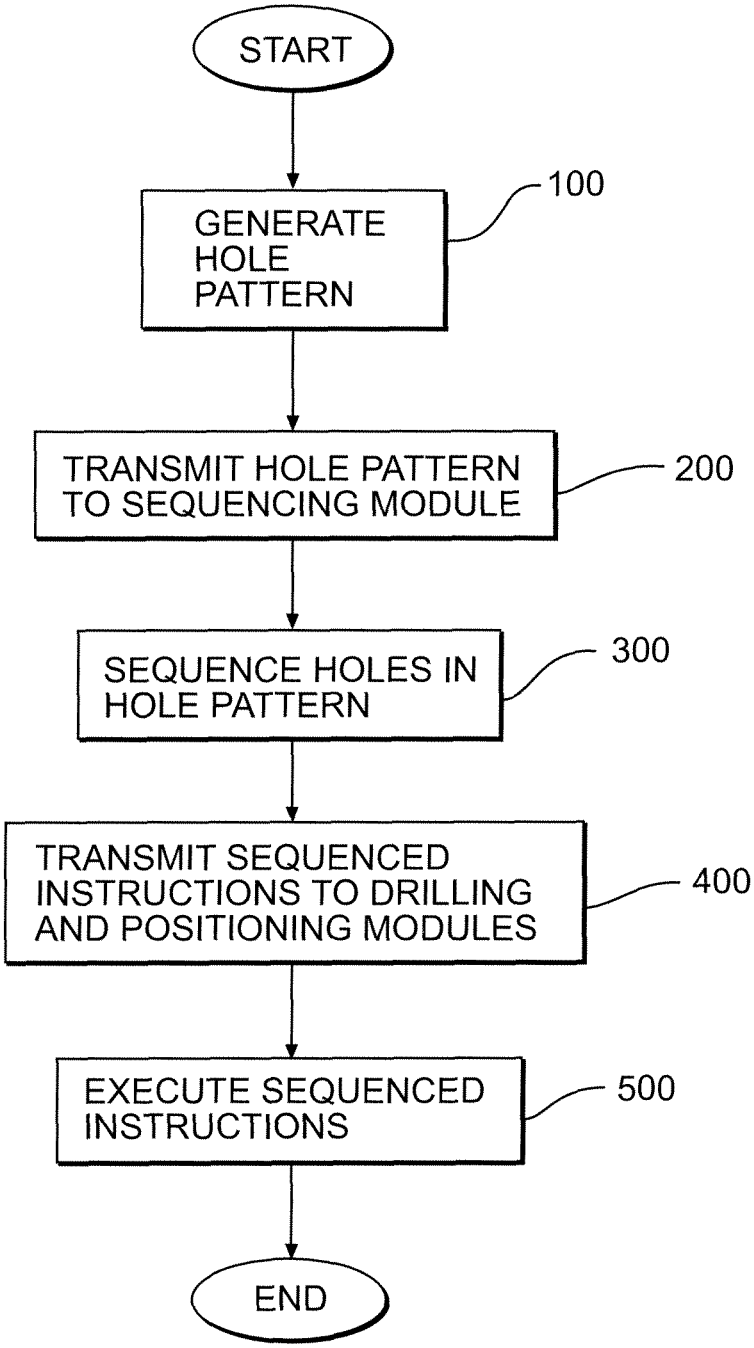
FIG. 3 is flowchart illustrating a method for sequencing and drilling holes.

FIG. 3 illustrates a method for sequencing drill holes to be drilled by machine 12. The process commences by generating a hole pattern (step 100). The hole pattern has a plurality of planned holes for drilling by machine 12. The pattern is then transmitted to sequencing module 46 (step 200). In one embodiment, the hole pattern may be generated at operation station 44 and transmitted to sequencing module 46 via communication device 42. It is also contemplated that the hole pattern may be generated by a module of controller 32 or another computer associated with machine 12 and then transmitted to sequencing module 46. It is further contemplated that the hole pattern may be transmitted to controller 32 via a physical storage device, such as a USB key, disk, or similar device.

After receipt of the hole pattern, controller 32, and specifically sequencing module 46, executes a sequencing algorithm to sequence the planned holes (step 300). The sequencing algorithm may be configured to sequence the order in which the planned holes are drilled to improve the efficiency of the drilling operation. Upon completion of the sequencing, sequencing module 46 may transmit the sequenced instructions to positioning and drilling modules 48 and 49 (step 400). Positioning module 48 and drilling module 49 then execute the sequenced instructions (step 500).

Positioning module 48 is configured to control movement of machine 12. Positioning module 48 may be configured to actuate power engaging devices 16 such that machine 12 traverses from a first hole in the sequenced instructions to a next hole in the sequenced instructions. Positioning module 48 may communicate with positioning system 36 and/or sensors 34 to determine a position, velocity (i.e., speed+direction), and/or acceleration of machine 12 and guide machine 12 to a planned hole location.

It is contemplated that positioning module 48 may seek to ensure that a center of curvature of machine 12 tracks along a planned pathway provided by the sequenced instructions. In order for controller 32 to better direct machine 12 along the planned pathway, positioning module 48 may include an adaptive positioning algorithm. The adaptive positioning algorithm may calculate the center of curvature for machine 12 in real time and account for weight shifts in machine 12, soil conditions, ground slope, and other factors that may affect the center of curvature.

To account for weight shifts in machine 12, the adaptive algorithm may receive feedback from sensors 34 providing data regarding, for example, movement of mast 18, any coiling or uncoiling of a power cable on machine 12 (in embodiments where machine 12 is powered by a remotely located generator), and consumption of fuel onboard machine 12. Controller 32 may also use imaging devices or other sensors to detect soil conditions and ground slope.

Controller 32 may use the sensor feedback, including the measured speed of ground engaging devices 16, in order to simulate how machine 12 should move for given ground engaging device speeds. Controller 32 may then compare the simulated results to actual machine position information received from positioning module 48. Controller 32 may determine a difference between the simulated results and the measurements from positioning module 48 and use the determined difference to improve the center of curvature model used in the simulations.

Drilling module 49 may be configured to control an orientation, speed, and length of drill 20 at a planned hole location such that desired hole characteristics are achieved. The desired hole characteristics may include, for example, hole depth and hole orientation (angle of hole, etc.). Drilling module 49 may communicate with sensors 34 in order to receive feedback regarding the drilling process.

Figure 4:
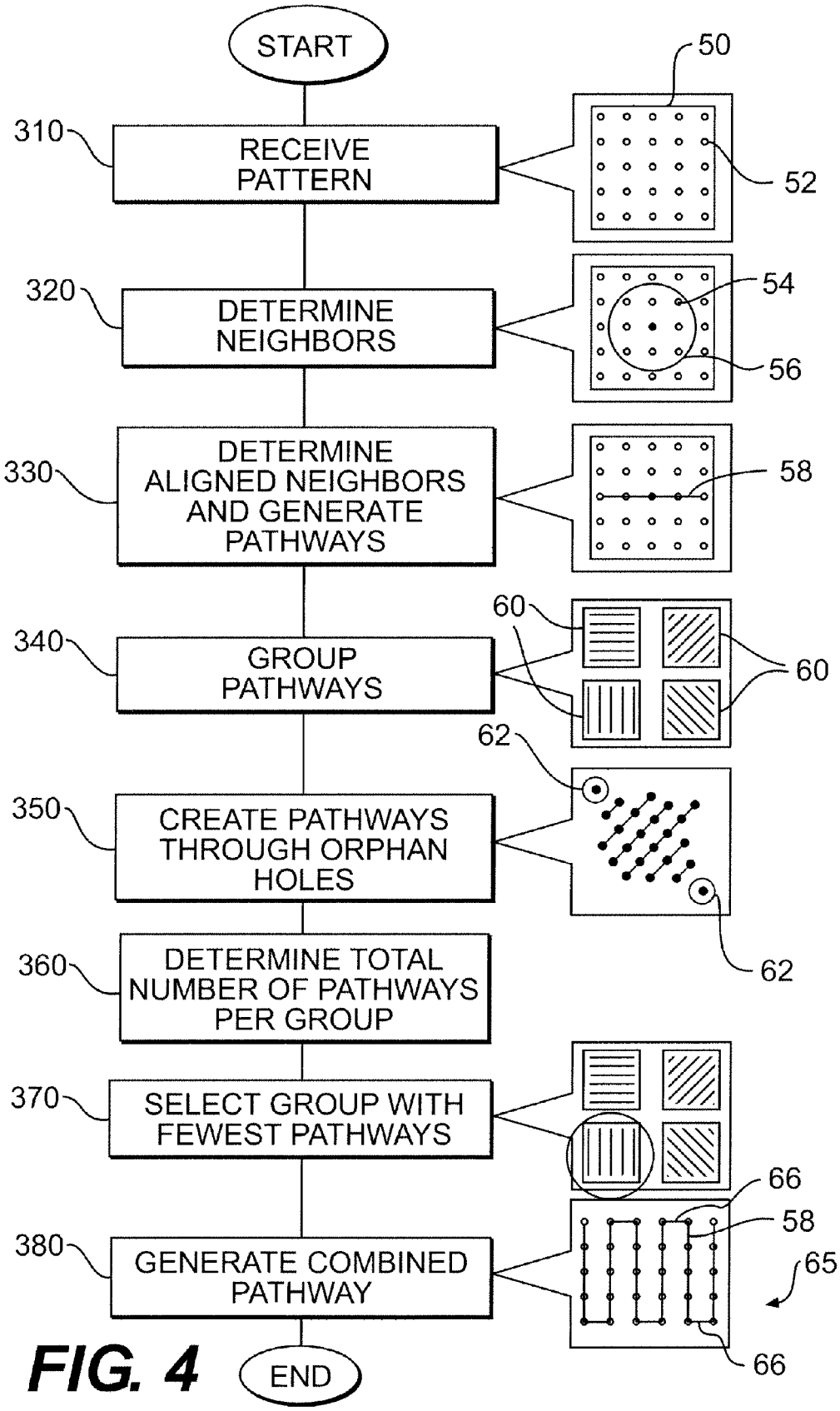
FIG. 4 is a flowchart illustrating a sequencing step of the method of FIG. 3.

FIG. 4 illustrates the sequencing algorithm of step 300 in more detail. Controller 32 may commence the sequencing algorithm when sequencing module 46 receives a pattern 50 of planned holes 52 (step 310). Pattern 50 may have a plurality of planned holes 52 for drilling by machine 12. Planned holes 52 of pattern 50 may be spaced apart in at least two directions. Controller 32 may proceed by determining neighboring (planned) holes 54 for each planned hole 52 of pattern 50 (step 320). To determine neighboring holes 54, controller 32 may select a first planned hole from pattern 50 and select planned holes that surround the first hole. Planned holes that surround the first hole are selected if the surrounding holes are located within a set distance 56 from the first hole. Set distance 56 may be, for example, 1.9 times the minimum distance between any planned hole 52 and any neighboring hole 54 in the entire pattern 50. The distance of 1.9 allows the algorithm to encompass adjacent holes about the first planned hole without encompassing two holes in a row in a radial direction from the first planned hole. It is contemplated that set distance 56 may also be programmed by an operator via user interface 39.

Once controller 32 has determined neighboring holes 54 for the first hole, controller 32 may select a second planned hole and determine the second hole's neighboring holes. This process may be continued until neighboring holes 54 for every planned hole 52 in pattern 50 have been determined.

Controller 32 may then search for aligned neighboring holes and generate planned pathways 58 (step 330). To search for aligned neighboring holes, controller 32 may select a starting planned hole and then select a neighboring hole of the starting hole. Controller 32 may then determine if a neighboring hole of the selected neighboring hole is aligned with the starting hole and the selected neighboring hole, thus forming a line of three holes (i.e., starting hole, selected neighboring hole, and neighboring hole of the selected neighboring hole). Controller 32 may determine that the starting hole, the selected neighboring hole, and the neighboring hole of the selected neighboring hole are aligned if the angle formed by the three holes is within a set range. The set range may be, for example, 170-190 degrees (180 degrees being the angle that forms a perfectly straight line). Since the planned holes may not be perfectly aligned, the range of 170-190 degrees may allow for some non-linearity between the three holes, but will prevent the algorithm from substantially deviating from a straight path. It is contemplated that the operator may review the results of the alignment on operator display 38 during execution of the algorithm, and the operator may adjust the set angle via user interface 39 to fine tune the results.

Controller 32 may continue determining aligned holes along a line until an edge of pattern 50 has been reached (in both directions). Controller 32 may use the aligned holes to generate a planned pathway connecting the planned holes.

Controller 32 may return to the initial hole and select another neighboring hole. Controller 32 may then determine the holes that are aligned with the initial hole and the second neighboring hole. This process may be repeated until all of the neighboring holes of the initial hole have been exhausted. At this point, controller 32 may select a new initial hole and repeat the process until all aligned holes for the entire pattern 50 have been determined.

In an alternative embodiment, it is contemplated that controller 32 may select a starting hole, and then select two neighboring holes of the starting hole (i.e., starting hole is located at a midpoint of the three hole series rather than at an endpoint). Controller 32 may then determine if the angle formed by the three holes falls within the set range and generate planned pathways 58 as discussed above.

Controller 32 may group the generated planned pathways 58 into groups 60 (step 340). Groups 60 may be based on one or more characteristics of each planned pathway 58, such as, for example, the slope or angle of each planned pathway 58. It is contemplated that the selection of the angle that defines each group may be automatically determined by controller 32. In one embodiment, controller 32 may determine and/or refine the angles of the groups as controller 32 adds planned pathways to the groups.

For example, controller 32 may take a first pathway, define a new group, and place the first pathway in the new group. Controller 32 may then take a second pathway and determine an angle between the second pathway and the first pathway. If the relative angle between the second pathway and the first pathway is within a preset variance (e.g., 22.5 degrees), then controller 32 may add the second pathway to the group of the first pathway. If the relative angle is outside of the variance, controller 32 may define a second new group and place the second pathway into the second new group. Controller 32 may then compare a third pathway to the first pathway and the second pathway in a similar manner. Specifically, if the relative angle between the third pathway and the first pathway is within the preset variance, then controller 32 may add the third pathway to the group of the first pathway. If not, controller 32 may perform a similar comparison for the third pathway and the second pathway (placing the third pathway in the group of the second pathway if within the set variance). If controller 32 determines that the third pathway does not belong in the group of either the first pathway or the second pathway, controller 32 may define another new group for the third pathway. This process of assigning planned pathways to groups and creating new groups when necessary is repeated until all of the planned pathways have been assigned to groups. It is contemplated that the set variance may be modified by the operator. In embodiments where the preset variance is set to 22.5 degrees, only four unique groups are formed. It is contemplated that the resulting groups may be displayed to and approved by the operator for verification purposes.

In an alternative embodiment, controller 32 may group all of the angles into a distribution and analyze the distribution to determine where the angles are concentrated. Controller 32 may designate a concentration of planned pathway angles as a group 60 if the number of planned pathways 58 having the given angle (within a given deviation) exceeds a preset threshold. It is also contemplated that the determination of groups 60 may be optimized. In other words, controller 32 may run a process that minimizes the number of groups 60 and simultaneously minimizes the deviation of the angles within each group 60. It is contemplated that controller 32 could use the same methods using slopes rather than angles.

Controller 32 may then proceed to ensure that a planned pathway 58 passes through all planned holes for each group 60 (step 350). If any planned holes 52 remain for a given group, i.e., an orphan hole 62, controller 32 may create a planned pathway 58 that passes through orphan hole 62 at the angle that defines the group so that the newly created planned pathway 58 is parallel to the remaining planned pathways 58 in the group.

Controller 32 may determine the total number of planned pathways 58 for each group 60 (step 360). Controller 32 may compare the total number of planned pathways 58 for each group 60 and then select the group that includes the least total planned pathways 58 (step 370).

Controller 32 may generate a combined pathway 65 (step 380). Combined pathway 65 may represent the pathway which machine 12 will travel in order to drill each planned hole 52. In some embodiments, controller 32 may verify that the combined pathway 65 directs machine 12 to pass over each planned hole 52 no more than one time.

Combined pathway 65 may be generated by generating linking pathways 66 between planned pathways 58 of the selected group. Specifically, linking pathways 66 may link at least one planned pathway from the selected set of pathways to at least a second planned pathway from the selected set of planned pathways. Linking pathways 66 may be configured to maximize the turning radius of machine 12. Additionally, when generating linking pathways 66, controller 32 may account for avoidance zones, such as, for example, highwalls and crests. Due to the weight of a typical machine 12 and a possibility of tipping, it is contemplated that controller 32 will generate linking pathways 66 such that machine 12 will generally travel perpendicular to crests or highwalls. When controller 32 has completed generating combined pathway 65, controller 32 may transmit combined pathway 65 in the sequenced instructions from sequencing module 46 to positioning module 48 and/or drilling module 49 for execution (see FIG. 3 step 400).

Figure 5:
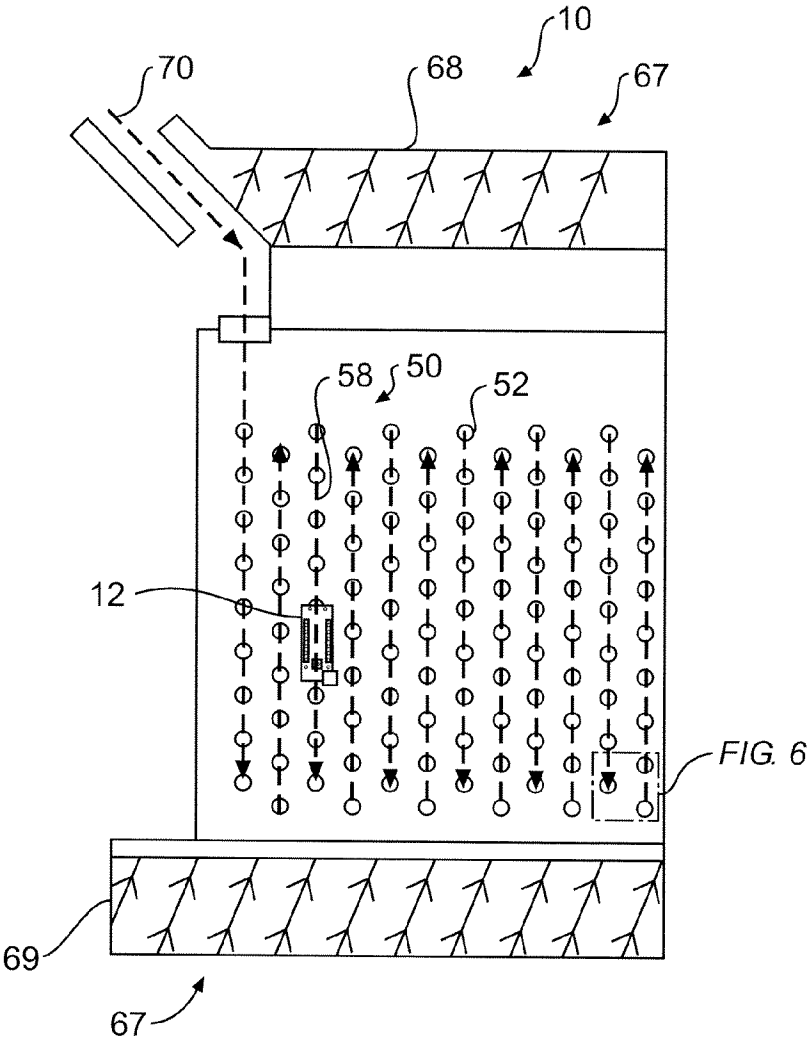
FIG. 5 is a diagrammatic illustration of a sequenced hole pattern used by the control system of FIG. 2.

FIG. 5 illustrates an exemplary pattern 50, including a sequenced combined pathway, overlain on a geographical representation of worksite 10. Combined pathway 65 may be configured to enter worksite 10 at entrance 70. Worksite 10 may have multiple avoidance zones 67, including a highwall 68 and a crest 69. In the illustrated embodiment, combined pathway 65 may have an essentially zig-zag or square-wave like pattern. Combined pathway 65 may be configured to be situated between highwall 68 and crest 69. In the embodiment of FIG. 5, pattern 50 may be configured to require machine 12 to pass near crest 69. To account for the proximity in this example, controller 32 may adjust linking pathways 66 near crest 69 to prevent machine 12 from traveling generally parallel to crest 69.

Figure 6:
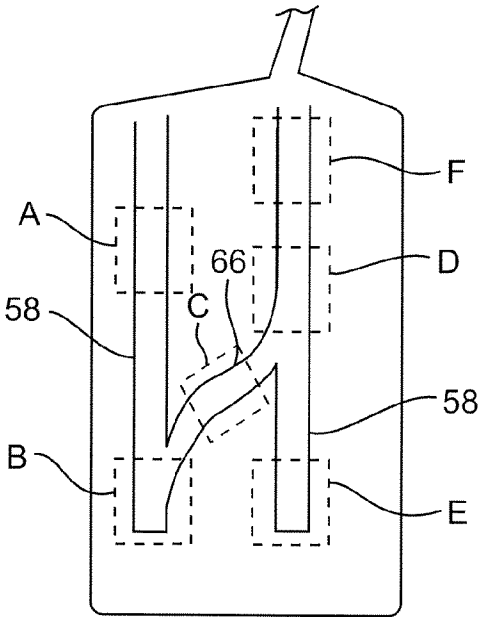
FIG. 6 is a diagrammatic illustration of a portion of the sequenced hole pattern of FIG. 5.

A modified linking pathway 66 is more clearly depicted in FIG. 6. In FIG. 6, combined pathway 65 approaches crest 69 (Position A). Combined pathway 65 then is configured to direct machine 12 to stop at an end of the current planned pathway on which it travels (Position B). Combined pathway 65 then directs machine 12 to reverse toward an adjacent planned pathway (Position C). Upon arriving at the adjacent pathway (Position D), combined pathway 65 is configured to direct machine 12 to pull forward to complete any planned holes in front of machine 12 (Position E). Combined pathway 65 then directs machine 12 to complete the remainder of the adjacent pathway (Position F) in reverse. In this manner, controller 32 creates linking pathways 66 to generally prevent machine 12 from traveling parallel to crest 69.

It is contemplated that controller 32 may generate a linking pathway 66 to avoid machine 12 driving parallel to a crest or highwall whenever hole pattern 50 calls for machine 12 to be within a predetermined proximity of the highwall or crest. The trajectory of linking pathway 66 may either be automatically created by controller 32 or it may be selected by controller 32 from a table of preset options based on which option maximizes the time at which machine 12 is perpendicular to the crest or highwall.

INDUSTRIAL APPLICABILITY

The sequencing method and sequencing algorithm may be applicable to any drilling device. The disclosed sequencing method may improve efficiency of a drilling operation by minimizing the planned changes of direction for the drill rig, while also preventing large gaps between concurrent holes in the hole sequence. The disclosed method also accounts for avoidance zones in order to improve safety and prevent machine down time.

It will be apparent to those skilled in the art that various modifications and variations can be made to the disclosed sequencing method. Other embodiments will be apparent to those skilled in the art from consideration of the specification and practice of the disclosed sequencing method. It is intended that the specification and examples be considered as exemplary only, with a true scope being indicated by the following claims.

What is claimed is:

1. A method for sequencing drill holes for a mobile drill rig, comprising:

receiving a hole pattern having a plurality of planned holes;

generating at least a first group of parallel pathways and a second group of parallel pathways between the plurality of holes of the hole pattern, the first group of pathways being angled relative to the second group of pathways;

selecting between the first group of pathways and the second group of pathways based on which group of pathways includes fewer total pathways;

generating a combined pathway by linking at least one pathway from the selected group of pathways to at least a second pathway from the selected group of pathways; and transmitting the combined pathway to a module configured to control movement of the mobile drill rig.

2. The method of claim 1, wherein generating the first and second group of parallel pathways includes selecting a first hole from the hole pattern and selecting holes that surround the first hole, wherein the holes that surround the first hole are selected if the surrounding holes are located within a set distance from the first hole.

3. The method of claim 1, wherein the module configured to control movement of the mobile drill rig includes an adaptive positioning algorithm configured to determine a center of curvature for the mobile drill rig.

4. The method of claim 2, wherein the set distance is 1.9 times the minimum distance between any two holes from the hole pattern.

5. The method of claim 2, wherein generating the first and second group of parallel pathways further includes:

selecting a second hole from the surrounding holes;

selecting a third hole from surrounding holes of the second hole;

determining if an angle formed by connecting the first hole, the second hole, and the third hole falls within a set range of angles; and generating a pathway through the first, second, and third hole if the determined angle is within the set range of angles.

6. The method of claim 5, wherein the range of angles is 170-190 degrees.

7. The method of claim 5, the first and second group of parallel pathways further includes:

generating a plurality of additional pathways through the plurality of holes;

determining a slope of each of the generated pathways;

grouping a first plurality of pathways into the first group of parallel pathways based on the slopes of the first plurality of pathways being similar; and grouping a second plurality of pathways into the second group of parallel pathways based on the slopes of the second plurality of pathways being similar.

8. The method of claim 7, further comprising verifying that each group of generated pathways has a pathway that passes through each hole of the hole pattern.

9. A method for controlling a mobile drill rig, comprising:

receiving a hole pattern having a plurality of planned holes spaced apart in at least two directions;

generating at least a first group of parallel pathways and a second group of parallel pathways through the plurality of holes of the hole pattern, the first group of pathways being angled relative to the second group of pathways;

selecting between the first group of pathways and the second group of pathways based on which group of pathways includes fewer total pathways;

generating a combined pathway by generating linking pathways between at least one pathway from the selected group of pathways and at least a second pathway from the selected group of pathways; and controlling with a controller the mobile drill rig based on the combined pathway.

10. The method of claim 9, wherein generating the first and second group of parallel pathways includes selecting a first hole from the hole pattern and selecting holes that surround the first hole.

11. The method of claim 10, wherein the holes that surround the first hole are selected if the surrounding holes are located within a set distance from the first hole.

12. The method of claim 11, wherein the set distance is 1.9 times the minimum distance between any two holes from the hole pattern.

13. The method of claim 10, wherein generating the first and second group of parallel pathways further includes:

selecting a second hole from the surrounding holes;

selecting a third hole from surrounding holes of the second hole;

determining if an angle formed by connecting the first hole, the second hole, and the third hole falls within a set range of angles; and generating a pathway through the first, second, and third hole if the determined angle is within the set range of angles.

14. The method of claim 13, wherein the range of angles is 170-190 degrees.

15. The method of claim 13, the first and second group of parallel pathways further includes:

generating a plurality of additional pathways through the plurality of holes;

determining a slope of each of the generated pathways; and grouping a first plurality of pathways into the first group of parallel pathways based on the slopes of the first plurality of pathways being similar; and grouping a second plurality of pathways into the second group of parallel pathways based on the slopes of the second plurality of pathways being similar.

16. The method of claim 15, further comprising verifying that each group of generated pathways has a pathway that passes through each hole of the hole pattern.

17. A control system for a mobile drill rig, comprising:

a positioning system configured to determine a position of the drill rig; and a controller in communication with the positioning system, the controller being configured to control movement of the drill rig, the controller configured to:

receive a hole pattern having a plurality of planned holes spaced apart in at least two directions;

generate at least a first group of parallel pathways and a second group of parallel pathways through the plurality of holes of the hole pattern, the first group of pathways being angled relative to the second group of pathways;

select between the first group of pathways and the second group of pathways based on which group of pathways includes fewer total pathways;

generate a combined pathway by linking at least one pathway from the selected group of pathways to at least a second pathway from the selected group of pathways; and control movement of the mobile drill rig based on the combined pathway and the position of the drill rig.

18. The control system of claim 17, further including one or more sensors configured to determine a sensed speed and direction of the drill rig, wherein the controller is further configured to control movement of the drill rig based on the sensed speed and direction.

19. The control system of claim 17, wherein generating the first and second group of parallel pathways includes:

selecting a first hole from the hole pattern and selecting holes that surround the first hole, wherein the holes that surround the first hole are selected if the surrounding holes are located within a set distance from the first hole;

selecting a second hole from the surrounding holes;

selecting a third hole from surrounding holes of the second hole;

determining if an angle formed by connecting the first hole, the second hole, and the third hole falls within a set range of angles;

generating a pathway through the first, second, and third hole if the determined angle is within the set range of angles;

generating a plurality of additional pathways through the plurality of holes;

determining a slope of each of the generated pathways;

grouping a first plurality of pathways into the first group of parallel pathways based on the slopes of the first plurality of pathways being similar; and grouping a second plurality of pathways into the second group of parallel pathways based on the slopes of the second plurality of pathways being similar.

20. The control system of claim 17, wherein the controller is configured to generate a third and a fourth group of parallel pathways, the controller being configured to select between the first, second, third, and fourth groups of parallel pathways based on which group of pathways includes fewer total pathways.

* * * * *